United States Patent [19]

Johns

[11] 4,021,075

[45] May 3, 1977

[54] EXCAVATORS

[76] Inventor: Robert W. Johns, 7318 - 50th St., Edmonton, Alberta, Canada

[22] Filed: Sept. 15, 1975

[21] Appl. No.: 613,324

[30] Foreign Application Priority Data

Sept. 23, 1974 Canada ..... 209775

[52] U.S. Cl. ..... 299/30; 299/33; 299/58; 299/75

[51] Int. Cl.[2] ..... E21D 9/10

[58] Field of Search ..... 299/31, 33, 58, 61, 299/75, 1, 19, 30

[56] References Cited

UNITED STATES PATENTS

| | | | |
|---|---|---|---|
| 3,420,577 | 1/1969 | Pertith | 299/31 |
| 3,547,493 | 12/1970 | Starkle | 299/75 |

FOREIGN PATENTS OR APPLICATIONS

| | | | |
|---|---|---|---|
| 813,706 | 5/1959 | United Kingdom | 299/75 |

*Primary Examiner*—Ernest R. Purser
*Assistant Examiner*—William F. Pate, III
*Attorney, Agent, or Firm*—Shlesinger, Arkwright, Garvey & Dinsmore

[57] ABSTRACT

This invention relates to excavating apparatus for use in the mining of bituminous sands, oil shale or other friable mineral deposits, and particularly adaptable for use in the "Fixed Arch Shield" mining technique. The excavating apparatus of the invention comprises a supporting framework having at least one excavator carrying member; guide means associated with that member; excavator support means constrained by the guide means for movement longitudinally of the member; means such as a hydraulic ram, for affecting movement of the support within the guide means; arm means pivotally mounted at an end thereof to the support means, and independent drive motors to affect rotation of the arm about its pivot and the ore cutting device respectively.

5 Claims, 4 Drawing Figures

EXCAVATORS

This invention relates to apparatus for the underground mining of bituminous sands, oil shale, and other friable mineral deposits. More particularly, but not exclusively, the invention provides an excavator for use in association with mining apparatus of the type disclosed and claimed in Applicants' co-pending United States Patent Applications: Ser. No. 509,489, filed Sept. 26, 1974, now U.S. Pat. No. 3,958,830; and Ser. No. 625,888, filed Oct. 28, 1975, now U.S. Pat. No. 3,906,408, and Ser. No. 625,889, filed Oct. 28, 1975, the latter two being divisions of Application Ser. No. 509,489.

Prior Application, Ser. No. 509,489, discloses a mining method which will be referred to hereafter as the "Fixed Arch Shield" technique of mining. This technique includes the establishing of a laterally extending underground mining face, against which a laterally extending mining shield is positioned, the mining shield serving to partially enclose mining machinery such as lateral shearing ploughs, rotary cutters or the like which are conventional in underground coal mining, the cutter operating across the full width of the mining wall. The mined material, after being cut from the mining face, falls onto a lateral conveyor operating within the mining shield, and is then conveyed from the face to collecting means, operating at the ends of the face for ultimate conveyance through a shaft to the ground surface.

The mining shield according to Application Ser. No. 502,296, is comprised of a large number of individual arch sections, each being individually advanceable towards the mining wall as the mining wall recedes, thereby creating a void posterially of the mining shield, leaving the "back" unsupported and permitted to collapse. Normally, the back will not subside for several hours after the advance of the shield, due to the "semi-plastic" nature of the sand, and the entrined viscous bitumen. Under normal mining operations, the "back" will collapse gradually, 20 to 40 feet behind the moving mining shields as it advances into the bituminous sand body.

The operation will proceed for an optimum distance of forward travel, and is then repeated, to operate on the collapsed material as before. As is described, the entire operation takes place on, or adjacent basement rock, the mining operation proceeding until the desired section of bituminous sand has been removed.

The cutting equipment is not manned, the cutter travelling between a pair of operators, one at each end of the assembled, moveable shield, each operator being positioned in a pulpit, in permanently supported manways.

Prior application Ser. No. 509,489 deals specifically with the pulpit which is generally a box structure positioned at each end of the mining shield and is used for housing operating personnel, and the remote controls for the mining equipment.

Since the Pulpit has to be advanced in the mining direction in a similar manner to the mining shield itself, it is necessary to excavate sufficient material from in front of the pulpit to provide room for the advancement. Whilst excavation can be carried out in front of the shield by various different types of known mining machines, these machines are not suitable to excavate in front of the pulpit.

The excavator according to the present invention is therefore in the preferred embodiment; an accessory of the pulpit which itself is a portion of the "Fixed Arch Shield" assemblage.

Accordingly, the present invention provides, in the mining of tar sands, oil shale, or other friable mineral deposits; excavating apparatus including: a supporting framework comprising at least one excavator carrying member; guide means associated with said member; excavator support means constrained by guide means for movement longitudinally of said member; means for affecting movement of said support means within said guide means; arm means, pivotally mounted at an end thereof to said support means; means for affecting rotation, at least in part, of said arm means about said support means; cutter means mounted for rotation on said arms at a position remote from said support means, and; means for affecting rotation of said cutter means.

A further important aspect of the present invention, as will be appreciated by one skilled in the art is that the excavator can also be utilized as an independent mining tool.

When mounted on a moveable carriage it can be operated, for example, to excavate areas not possible with conventional large scale mining equipment. Additionally by making the carriage self propelled, and providing a remote control system for the carriage drive and the excavator, it is invisaged that such a tool could be utilized to automatically drive a tunnel complex from a computer read-out.

A preferred embodiment of the invention, as used in conjunction with a "Fixed Arch Shield" assemblage, however, will now be described, by way of example, reference being had to the accompanying drawings in which.

For ease of understanding, and in order that reference may be readily made to the prior mentioned applications, the attached drawings have been enumerated such that interelated components, between this application and the previously mentioned co-pending applications, carry like numerals, where possible.

Figure 1:
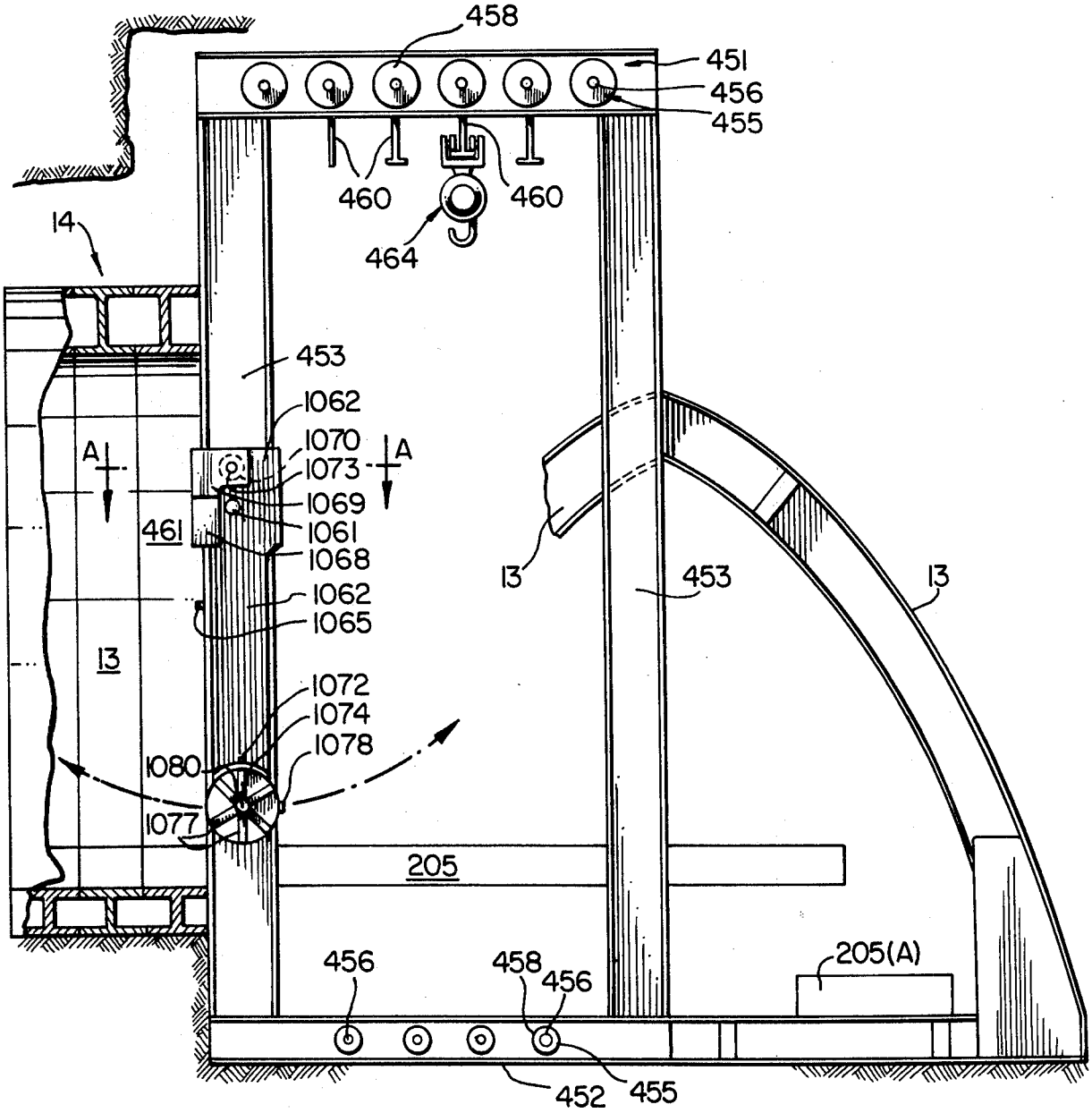
FIG. 1 is a front view, partially in section, of a pulpit, mining shield, and transverse service tunnel, the pulpit incorporating the excavator according to the present invention.
Figure 2:
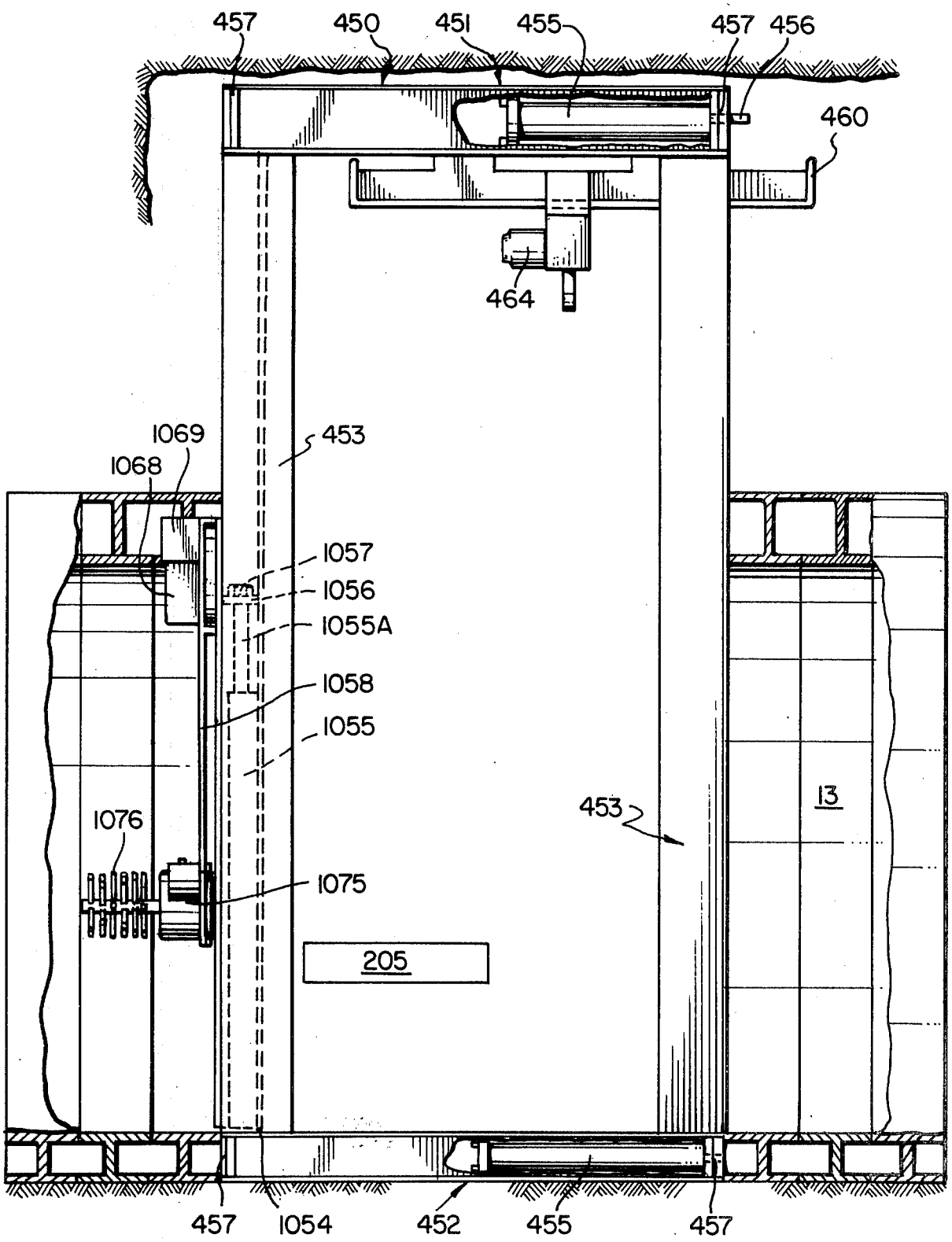
FIG. 2 is a side view, partially in section, of the arrangement according to FIG. 1.

Briefly describing the pulpit, and its significance, reference is made to FIGS. 1 and 2, which disclose a box structure generally designated 450, which is positioned at each end of a mining shield 14.

Normally, the mining shield 14 will not be manned, the mining machine (not shown) operating in slow oscillation between opposite ends thereof, the mined sand being conveyed along the mining wall to the ends thereof for delivery to one of the operating tunnels, indicated at 13, for ultimate transportation to the surface. However, at each end of the mining shield, a rectangular structure 450, or pulpit, is provided, for housing operating personnel and the remote controls of the mining equipment.

FIGS. 1 and 2 disclose the rectalinear design of the pulpit, and its relationship to the operating tunnel 13, and the mining shield 14. The pulpit is open on all four sides, and comprises a reinforced roof section 451, and a floor section 452, and four similar H-beam columns 453, positioned at the corners thereof and secured, as by welding.

Dimensionally, the roof and floor sections 451, 452, are desirably square, the side thereof being equal to the exterior dimension of the base of the arch sections 13, increased by the width of the mining face (not shown).

One pulpit of a pair, will house the delivery end of a chain conveyor 205 and the drive means (not shown) for the conveyor. The conveyor 205 discharging onto a transfer conveyor 205(A), in the operating tunnel 13. The other pulpit of the pair will house the tail end assembly, of the previously mentioned conveyor 205.

As depicted, the roof section 451, and floor section 452, are desirably constructed of H-section to provide strength and support for the overhead crane depicted generally at 464.

Provisions for advancing the pulpit forwardly in response to mining progress, is achieved by a plurality of pneumatic jacks 455 in both the roof section 451, and floor section 452, which will engage respectively, sand in situ and the side of an adjacent tunnel arch section 13.

The pneumatic jacks 455, are desirably mounted within the voids between adjacent H-members of the roof and floor sections 451, 452, and the plunger rods thereof, 456, will extend through apertures in end plates (not shown) formed in the aforementioned end plates.

When it is necessary to advance the pulpit in response to forward progress of the mining machine, the overhead crane will be run out on its track 460, to engage the next forwardly adjacent arch section of tunnel 13, which will be lifted out of position, moved inside the pulpit, which will be advanced into the void created by the removal of this arch section, by actuation of the pneumatic jacks 455 in the roof and floor sections 451, 452, whereupon, the arch section will then be reinstalled to the rear of the pulpit, in the void thus created by movement of the pulpit.

Before the pulpit can be advanced, it is necessary to excavate ground in the direction of advance, at least for a distance equal to the thickness of one of the aforementioned arch sections.

In accordance with the present invention, an excavator is provided which is attached to one of the uprights, or standards, of the pulpit, and which device is capable of rotation about a support, which itself is constrained for vertical movement, within the confines of the H-beam section.

Looking now to the components utilized to attached the excavating device to the pulpit, and to the components of the excavator itself, the following, a basic description is provided.

The open sections, of H-beams 453, of the pulpit are fitted with guide strips 1053, which serve to partially close the section, and to retain, and guide, the excavator in its vertical travel.

Figure 3:
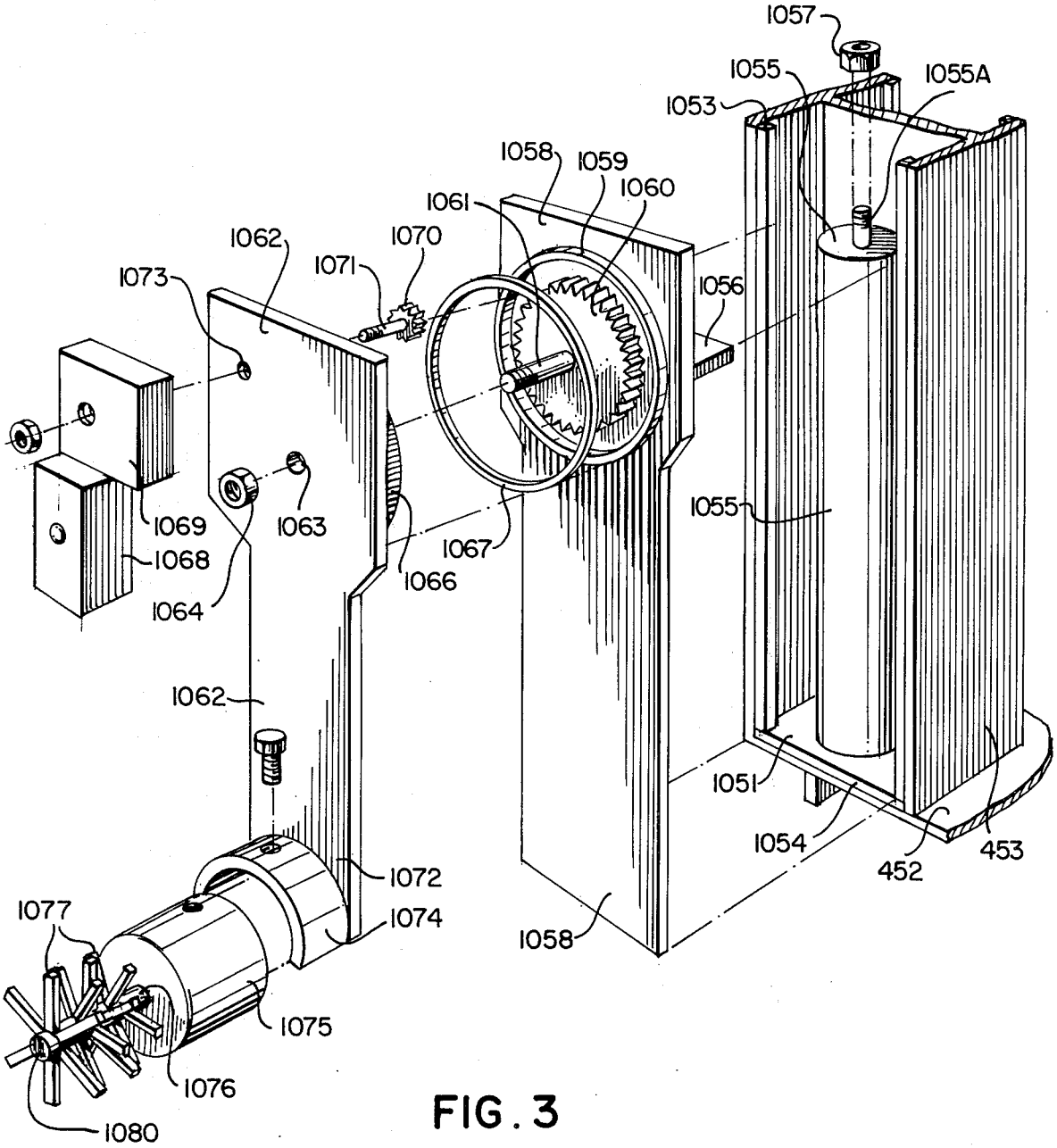
FIG. 3, is an exploded view of the basic components of the excavator and its association with a portion of the pulpit.

Mounted within the H-beam section, as shown in dotted outline in FIG. 2, and in more detail in FIG. 3, is a ram 1055 which may be hydraulic, or pneumatically operated. The ram is positioned on a base 1054, which is inserted into the space within the H-beam through an opening 1051 in guides 1053.

The plunger 1055A of the ram 1055 is connected to a top plate 1056, through a hole drilled in the top plate, and is held in place by a castalated nut 1057 (FIG. 3).

Figure 4:
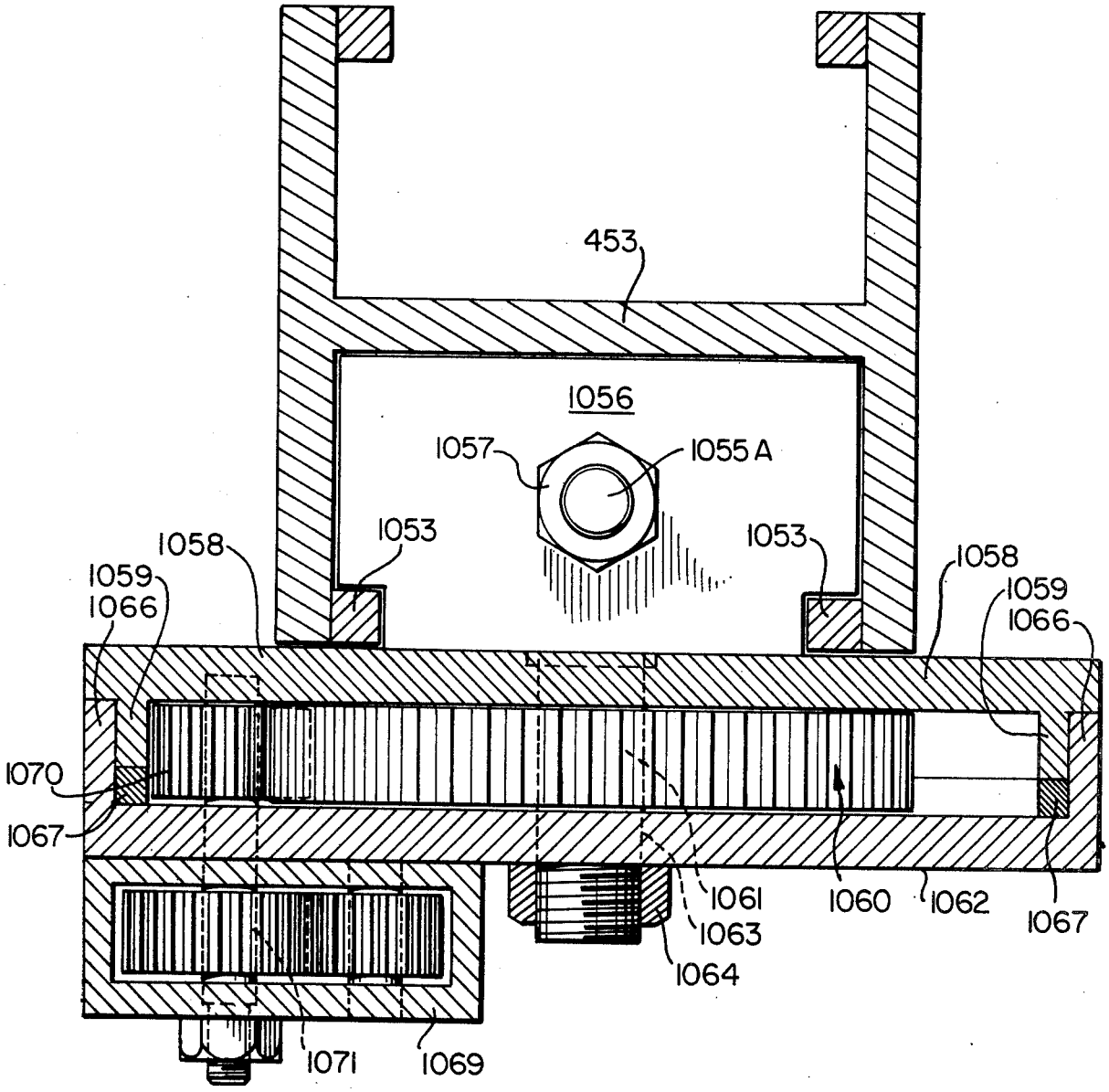
FIG. 4, is a cross-section taken at A—A, FIG. 1, depicting the assembly of the main excavation mechanism and its attachment to a portion of the pulpit.

The top plate, is welded to a face plate 1058, to which is attached, as can be seen from FIG. 4, a shaft 1061, a gear 1060, and a retaining ring 1059 which retains lubricant around the gear 1060.

A swinging arm, 1062 is provided having an orifice 1063, which fits over the shaft 1061, and is held in place by a castalated nut 1064, thus allowing the swinging arm 1062 to rotate on the shaft 1061.

A retaining ring 1066 is attached to the swinging arm 1062, and machined to fit with the retaining ring 1059, on the face plate 1058.

A gasket 1067, (FIG. 4) is fitted between the retaining rings 1059 and 1066, to seal the lubricant within the gear chamber.

The gear 1060 is fixed to the face plate 1058, and is machined to match with a pinion 1070 which is driven by an axle 1071 passing through the orifice 1073 in the swinging arm 1062.

The axle 1071 is connected to a conventional speed reducing gear train 1069, which is driven by a motor 1068 mounted on the forward face of the swinging arm 1062, to thus cause rotation thereof. At the outer end 1072 of the swinging arm 1062, a further motor 1075 is provided, preferably attached to the swinging arm by a portion 1073 of swinging arm 1062.

The motor 1075 drives a cutting device 1080, through an axle 1076. The cutting device 1080 being provided with cutting teeth 1077, which are helically arranged about the axle 1076, so that any material cut by the teeth 1077 is thrown from the face.

The cutting motor 1075 may be hydraulic, pneumatic, or electrically actuated.

In operation, when the arch 461 (FIG. 1) is removed from in front of the pulpit 450 in the normal operation of the arch shield, the pulpit 450 is advanced into the opening so formed by the action of the pulpit rams 455.

The cutting device 1080, is usually kept constantly in operation, forced ahead by the movement of the pulpit 450, and cuts into the unexcavated material ahead of the pulpit 450 in the position shown in FIG. 2.

As soon as the pulpit 450 is advanced the desired amount and the cutting device has dug into the unexcavated material, the ram 1055 is actuated (automatically or manually), and the excavation made by the cutting device 1080 is enlarged vertically.

When the cutting device 1080 has been moved to the limit of travel of the ram 1055, the motor 1068 is actuated. As the gear 1060 is held fixedly to the face plate, 1058, operaton of the swinging motor 1068, through the axle 1071 and the pinion 1070, causes the swinging arm to revolve about the fixed shaft 1061.

By synchronizing the movement of the ram 1055 and the swinging arm 1062, a block of material can be excavated, which is a function of the radius of the swinging arm 1062 and the travel of the ram 1065. This can be guided manually by the operator from within the pulpit, or can be programmed by a control unit so that the block of material is removed automatically.

The penetration of the cutting device 1080 is equal to the thickness of the arch 461, so that, when the next arch 461 is removed ahead of the pulpit 450, space is available that the pulpit 450 can be advanced as required.

If the radius of the swinging arm 1062 about the fixed lug 1061 and the vertical movement of the ram 1055, combined, is insufficient to allow excavation of the necessarry volume required to permit free movement of the pulpit, a second pulpit excavator (not shown) may be installed on the other front standard 453 of the pulpit, and programmed to excavate the additional material.

Safety stops 1065, are provided to limit the movement of the swinging arm 1062 so that the cutting device 1080 does not hit the arches, of adjacent structures.

If two pulpit excavators 1051 are installed on the same pulpit 450, additional safety stops 1078 are installed to prevent the two excavators from interfering during operation.

As it will be seen, the invention as described herein, provides a practical and effective means of excavating small areas in front of the pulpit, which excavation can be carried out with a minimal amount of danger to an operator.

In the foregoing description, the best known method of carrying out the invention has been outlined, however it must be understood that alterations and amendments may be made to the method and apparatus as described, by way of improvement, without departing from the spirit of the invention and the principles involved as defined in the copended claims.

What I claim is:

1. In the mining of tar sands, oil shales, or other friable mineral deposits, excavating apparatus including:

a. a supporting framework comprising a carriage having at least one excavator carrying member, said member being upright and of generally open channel section;

b. guide means attached to said upright member;

c. excavator support means constrained by said guide means for movement longitudinally of said member;

d. means for affecting movement of said support means within said guide means and comprising pressure actuate ram means positioned within said member and adapted to apply pressure to said excavator support means for vertically adjusting said excavator support means;

e. said excavator support means comprising a member slideably positioned within said section and maintained therein by said guide means;

f. arms means pivotally mounted at an end thereof to said support means;

g. means for affecting rotation, at least in part, of said arm means about said support means;

h. cutter means for rotation on said arm means at a position remote from said support means, and i. means for affecting rotation of said cutter means.

2. Apparatus according to claim 1 wherein said carriage is a pulpit and said excavator is utilized to remove material from in front of said pulpit to facilitate movement thereof in the mining direction.

3. Apparatus according to claim 1, wherein said support means further includes a face plate attached as by welding, to said support means, and serving to close said section, at least adjacent the moving part of said ram, to prevent ingres of excavated material thereto.

4. Apparatus according to claim 1 wherein said face plate has shaft means extending therefrom, upon which, said arm means is pivotally mounted.

5. Apparatus according to claim 1 wherein said supporting frame is in the form of a moveable carriage, having independent drive means, wherein said excavating apparatus, and said carriage drive means, are remotely controlled.

* * * * *